US008721022B2

(12) United States Patent
Izawa et al.

(10) Patent No.: US 8,721,022 B2
(45) **Date of Patent: *May 13, 2014**

(54) DIGITAL PRINTING METHOD AND A SYSTEM THEREFOR

(75) Inventors: Hideo Izawa, Narashino (JP); Yuuichi Yamazaki, Narashino (JP)

(73) Assignee: Miyakoshi Printing Machinery Co., Ltd., Narashino (JP)

( * ) Notice: Subject to any disclaimer, the term of this patent is extended or adjusted under 35 U.S.C. 154(b) by 133 days.

This patent is subject to a terminal disclaimer.

(21) Appl. No.: 13/339,800

(22) Filed: Dec. 29, 2011

(65) Prior Publication Data

US 2012/0242735 A1 Sep. 27, 2012

(30) Foreign Application Priority Data

Mar. 25, 2011 (JP) ..... 2011-067267

(51) Int. Cl.
*B41J 29/38* (2006.01)

(52) U.S. Cl.
USPC ..... 347/16; 347/5; 347/14; 347/19; 347/104

(58) Field of Classification Search
CPC ..... B41J 29/38
USPC ..... 347/5, 14, 16, 19, 104
See application file for complete search history.

(56) References Cited

U.S. PATENT DOCUMENTS

| | | | | |
|---|---|---|---|---|
| 4,569,584 | A | 2/1986 | St. John et al. | |
| 7,295,223 | B2 * | 11/2007 | Jung | 347/177 |
| 7,515,284 | B2 * | 4/2009 | Hanazato | 358/1.12 |
| 7,552,995 | B2 * | 6/2009 | Nakazawa et al. | 347/40 |
| 7,661,361 | B2 * | 2/2010 | Kanasugi et al. | 101/488 |
| 2005/0174379 | A1 | 8/2005 | Nakazawa et al. | |
| 2007/0222805 | A1 * | 9/2007 | Moscato et al. | 347/12 |
| 2008/0278757 | A1 * | 11/2008 | Wong | 358/1.18 |
| 2010/0245058 | A1 * | 9/2010 | Kojima | 340/10.52 |

FOREIGN PATENT DOCUMENTS

| | | |
|---|---|---|
| EP | 0 399 287 | 11/1990 |
| JP | 2005-335145 | 12/2005 |
| WO | WO 2007/092490 | 8/2007 |

* cited by examiner

*Primary Examiner* — Manish S Shah
*Assistant Examiner* — Jeremy Delozier
(74) *Attorney, Agent, or Firm* — Cozen O'Connor

(57) ABSTRACT

Images, one per page, are printed by a digital printer consecutively on a web of paper fed to travel forward. A timing mark is printed for each image. In case printing is temporarily halted, the web of paper is first fed backward, and then it is fed forward again. The number of timing marks in each of the backward feed and forward feed of the web of paper are counted. When the number of counts of the timing marks counted in the forward feed coincides with the number of counts of the timing marks counted earlier in the backward feed, printing of consecutive images is reinitiated from a position immediately following an image last printed before printing was temporarily halted.

4 Claims, 3 Drawing Sheets

DIGITAL PRINTING METHOD AND A SYSTEM THEREFOR

TECHNICAL FIELD

The present invention relates to a digital printing method and a system therefor in which images each for one page are printed repetitively or consecutively on a web of paper for rotary press using a digital printing press such as an ink jet printer or electrophotographic printer and in which after a printing operation is halted temporarily en route therein, the printing operation is reinitiated.

BACKGROUND ART

In printing methods of this sort as in an ordinary rotary printing method, as shown e. g., in JP 2005-335145 A a web of paper for rotary press printed on by an ink jet printer is fed to travel at a predetermined speed unidirectionally from a paper feeder unit to a paper takeup unit.

In the printing methods of this sort, for a variety of reasons such as ending of printing data, division of printing data for each of small numbers of copies, a mechanical reason as adjustment, checking of a printing state and operational convenience, there may en route be temporary halts of or suspensions from continuous printing operation, the printing operation being subsequently reinitiated.

In that method in which a web of paper in course of printing is fed to travel at a fixed speed, the web of paper caused to halt on the way travels up over a certain distance, leaving a portion left blank due to inertia of the printing system. And, when printing is reinitiated, the printing operation is initiated on a portion of paper following the blank portion of paper produced when printing is temporarily halted en route, with the result that such blank portions are mixed as NG portions of printed paper in a paper takeup roll downstream in the printing system.

Consequently, in conventional digital printing methods of this sort the problem has come up that if a printing operation after it is temporarily halted en route therein is reinitiated, in a process of post-processing a takeup roll of printed paper, steps of treating NG portions of printed paper become complicated and troublesome. Further, where a printing speed exceeding 200 m/min is available in the latest printing method, the problem has arisen that a blank portion of printed paper produced when printing is halted temporarily en route is elongated, giving rise to an increase in the amount of broke or waste of paper.

In view of the foregoing problems, it is an object of the present invention to provide a digital printing method as well as a system therefor which, if a continuous printing operation after it is halted temporarily en route is reinitiated, is capable of printing without producing waste of paper due to a portion left blank on a web of paper for rotary press.

DISCLOSURE OF THE INVENTION

In order to achieve the object mentioned above, there is provided a digital printing method in which images each for one page are printed by a digital printer consecutively on a web of paper for rotary press fed to travel forwards and in which printing after it is halted temporarily en route is reinitiated on the web of paper fed again to travel forwards, wherein the method comprises the steps of: printing a timing mark for each of the images; in re-printing after printing is temporarily halted en route, feeding the web of paper backwards so that a plurality of images printed thereon before printing is temporarily halted travel towards upstream of the digital printer and thereafter feeding the web of paper forwards again, and counting, upstream of the digital printer, the number of such timing marks each for the image in each of the forward feed and back feed of the web of paper, and when the number of counts of the timing marks counted in the forward feed coincides with the number of counts of the timing marks counted in the backward feed, reinitiating to print consecutive images form a position immediately following an image last printed before printing is temporarily halted.

In the digital printing method mentioned above, a distance of travel of the web of paper upstream of the digital printer may be detected by a travel distance detector, and when the number of counts of the timing marks counted in the forward feed coincides with the number of counts of the timing marks counted in the backward feed to reinitiate printing, a position and timing to reinitiate printing is determined from detected values by the travel distance detector.

The present invention also provides a digital printing system for carrying out a digital printing method as mentioned above, wherein the system comprises: a digital printer for printing images each for one page and timing marks each for each of the images consecutively on a web of paper fed to travel forwards; an upstream and a downstream roll unit positioned upstream and downstream, respectively, of the digital printer in a direction of forward feed, the roller units being operable synchronously to feed the web of paper to travel forwards in printing thereon and to feed the web of paper to travel backwards after printing is temporarily halted en route; a paper feeder and a paper takeup unit provided upstream of the upstream feed roll unit and downstream of the downstream feed roll unit, respectively, and rotatable normally and reversely in conjunction with operations of both the feed roll units; a mark sensor positioned upstream of the digital printer in the direction of forward feed for counting timing marks in backward feed after printing is temporarily halted en route en route and timing marks in its subsequent forward feed; and a control unit furnished with a number of counts from the mark sensor in the backward feed after printing is temporarily halted en route and a number of counts from the mark sensor in its subsequent forward feed and operable, when the number of counts of the timing marks counted in the subsequent forward feed coincides with the number of counts of the timing marks counted in the backward feed, for providing the digital printer with a signal commanding to reinitiate printing consecutive images from a position immediately following an image last printed before printing is temporarily halted.

In the digital printing system mentioned above, upstream of the digital printer there may be provided a travel distance detector for detecting a distance of travel of the web of paper, the control unit is adapted to receive detected values by the travel distance detector and signals from the mark sensor, and a detection signal from the travel distance detector determines a position and timing to reinitiate printing.

The digital printing method according to the present invention allows printing with a digital printer without producing a portion left blank if printing is suspended en route and thereafter reinitiated.

In a printing operation using a digital printer, for a variety of reasons such as ending of printing data, division of printing data for each of small numbers of copies, a mechanical reason as adjustment, checking of a printing state and operational convenience, there may be circumstances in which the printing system must en route be temporarily halted or suspended from its continuous operation. According to the proposed method which, if a printing operation after it is temporarily halted is reinitiated, allows reinitiating to print consecutive images starting from a position immediately following an image last printed thereon before printing is temporarily halted, the possibility can be eliminated of yielding a paper product which, with a blank or unprinted paper portion or portions, fails to become a satisfactory product and is then treated. It follows, therefore, that the yield rate of printed webs of paper for rotary press is improved.

Also, where portions failing to become satisfactory products are mixed in a web of paper taken up in a roll in the paper takeup unit, while removing those portions has hitherto required an operation in a number of steps of the post-processing process, this problem is resolved by the proposed method, which thus rises the efficiency of operation.

Further, where portions failing to become satisfactory products are mixed in a printed web of paper taken up in a roll as mentioned above, while the post-processing process of processing them has hitherto been complicated, tending to bring about a failure in operation for sorting so mixed NG paper portions in the production control aspect and giving rise further to the problem of involving useless works thought necessary to prevent such failures, a web of paper as printed according to the proposed method and taken up can, as it is, constitute a product that has been continuously printed and can as a whole be continuously processed in the post-processing configuration, thus sharply rising the efficiency of production of products.

BEST MODES FOR CARRYING OUT THE INVENTION

Figure 1:
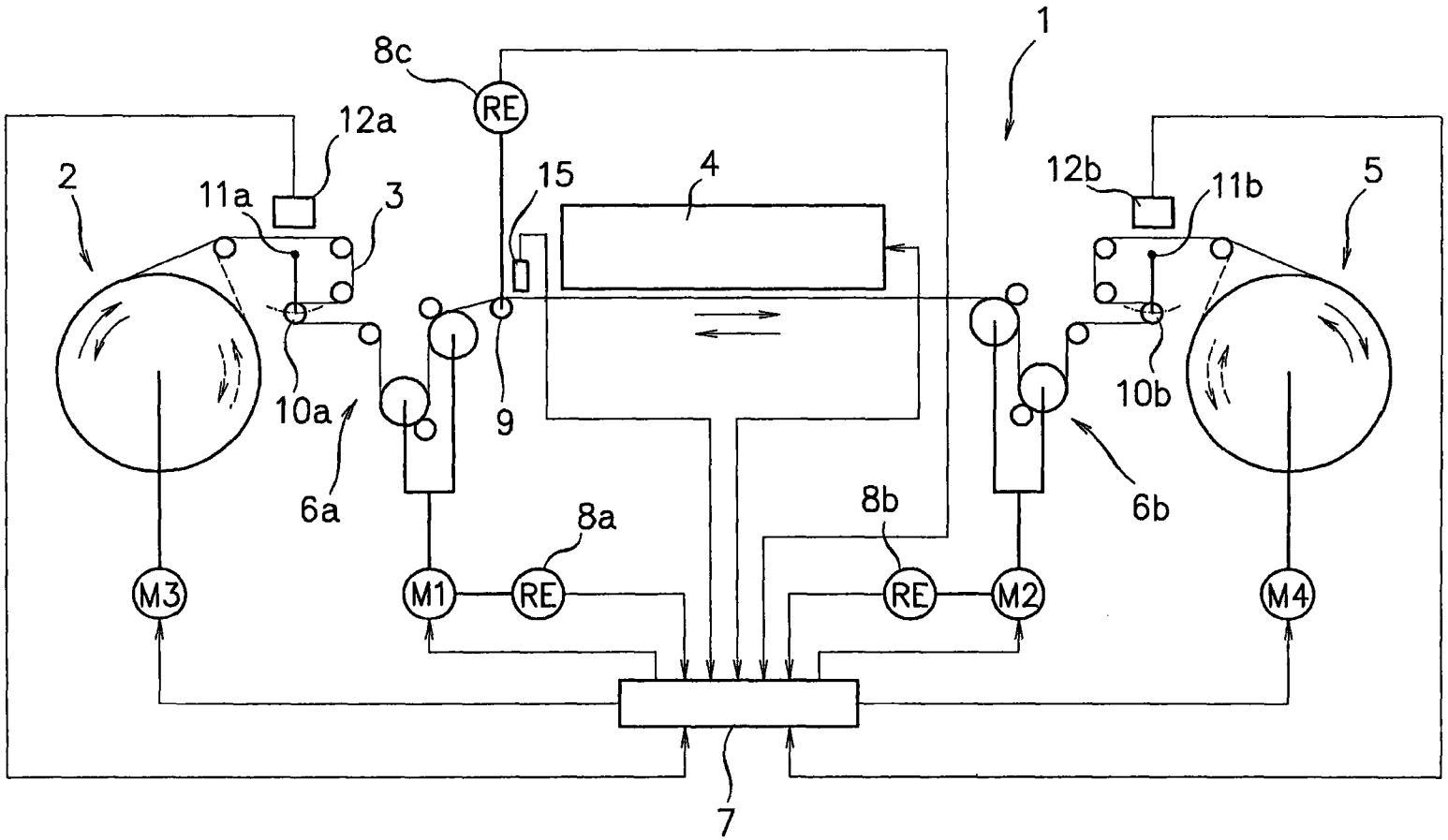
FIG. 1 is an explanatory view diagrammatically the makeup of a digital printing system according to the present invention.

FIG. 1 shows a digital printing system 1 according to the pre-present invention. The basic makeup of digital printing system 1 is such that a web of paper 3 for rotary press supplied from a paper feeder unit 2 is printed by an ink jet printer 4 as an example of a digital printing press and then taken up by a paper takeup unit 5. The web of paper 3 for rotary press is here designed to be fed to travel forwards, i.e., from the paper feeder unit 2 towards the paper takeup unit 5, and also to travel backwards, i. e., from the paper takeup unit 5 towards the paper feeder unit 2.

Upstream and downstream of the ink jet printer 4 in the direction of forward travel of the web of paper 3 there are provided feed roll units 6*a* and 6*b* driven controllably to rotate bi-directionally, i. e., both normally and reversely, singly by drive motors M1 and M2, respectively. By causing the feed roll units 6*a* and 6*b* to be driven controllably to rotate normally and reversely singly by drive motors M1 and M2, respectively, the web of paper 3 for rotary press can be fed to travel forwards, i. e., from the paper feeder unit 2 towards the paper takeup unit 5 and to travel backwards, i. e. from the paper takeup unit 5 towards the paper feeder unit 2.

Here, the motors M1 and M1 for the feed roller units 6*a* and 6*b* when driven to feed the web of paper 3 to travel both forwards and backwards are controlled in rotation so as to ensure that the rate of feed of the web of paper 3 by the feed roller unit then switched downstream is made slightly higher than that of the web of paper 3 by the feed roller then switched upstream whereby the web of paper 3 traveling beneath the ink jet printer 4 has a normal tension applied thereto.

The paper feeder unit 2 and the paper takeup unit 5 are driven by motors M3 and M4, respectively, so that they concurrently rotate normally and also concurrently rotate reversely. Thus, the paper feeder and takeup units 2 and 5 both feed out and roll in the web of paper 3 in accordance with the rates of forward and backward feed of the web of paper 3 by the feed roll units 6*a* and 6*b*, respectively.

The motors M1, M2, M3 and M4 are controlled in rotation by a control unit 7. And, encoders 8*a* and 8*b* are provided to detect rotations (rotational speeds and positions) of the motors M1 and M2 for driving the feed roller units 6*a* and 6*b*, respective values detected by them being fed back to the control unit 7.

Also, upstream of the ink jet printer 4 there is provided a free roll 9 rotated by travel of the web of paper 3. The number of rotation of the free roll 9 is detected as a distance of travel of the web of paper 3 by an encoder 8*c* and a value detected by it is fed back to the control unit 7, wherein the free roll 9 and the encoder 8*c* detecting its number of rotation constitutes a travel distance detector for detecting a distance of travel of the web of paper 3.

In the form of implementation of the invention illustrated in FIG. 1, between the paper feeder unit 2 and the feed roller unit 6*a* on the paper feeding side and between the paper takeup unit 5 and the feed roller 6*b* unit on the paper taking-up side, there are provided dancer rolls 10*a* and 10*b*, respectively, having portions of the web of paper 3 between the units wound on them for causing tensions in such portions of the web of paper. The tensions caused by the dancer rolls 10*a* and 10*b* in the portions of the web of paper 3 are generated by imparting selected rotation torques to dancer roll primary shafts 11*a* and 11*b* supporting the dancer rolls 10*a* and 10*b*, respectively. Means for generating such a rotation torque may be by one that can be selected from a way of applying a weight to a rotary lever (not shown) anchored to the dancer roll primary shaft 11*a*, 11*b*, a way of applying a fixed force of a bellofram cylinder to the rotary lever and varieties of other like ways.

A deviation in position of the dancer roll 10*a*, 10*b* is detected by a dancer position detector 12*a*, 12*b* disposed opposite to the rotary lever fixed to the dancer roll primary shaft 11*a*, 11*b*. The rotation of a shaft of rolled paper in the paper feeder unit 2, the paper takeup unit 5, is thus controlled in accordance with the deviation in position of the dancer roll 10*a*, 10*b* detected by the dancer position detector 12*a*, 12*b*.

To wit, a movement of the dancer roll 10*a*, 10*b* is detected by the dancer position detector 12*a*, 12*b*. And, so that the dancer roll 10*a*, 10*b* is held at a predetermined position, a signal from the dancer position detector 12*a*, 12*b* is fed to the control unit 7, and the rotary drive of the rolled paper in its feed direction, its takeup direction in the paper feeder unit 2, the paper takeup unit 5 is controlled by a control signal from the control unit 7.

In the makeup mentioned above, the synchronous feed operation of the feed roll units 6*a* and 6*b* in each of the forward and backward directions maintains the tension of the web of paper 3 predetermined and appropriate each between the rolled paper in the paper feeder unit 2 and the feed roll unit 6*a* and between the rolled paper in the paper takeup unit 5 and the feed roll unit 6*b* and between the both feed roll units 6*a* and 6*b*. While the tension is being so maintained, the web of paper 3 can be switched into either forward or backward direction of travel. In FIG. 1, note here that the arrows shown indicate the forward and backward directions of rotation of each of the rolls in the paper feeder unit 2 and the paper takeup unit 5, of which the solid arrows represent the case of printing on an outer side face of the web of paper 3 wound in the form of a roll and the broken arrows represent the case of printing on an inner side face of the web of paper 3 wound in the form of a roll.

Figure 2:
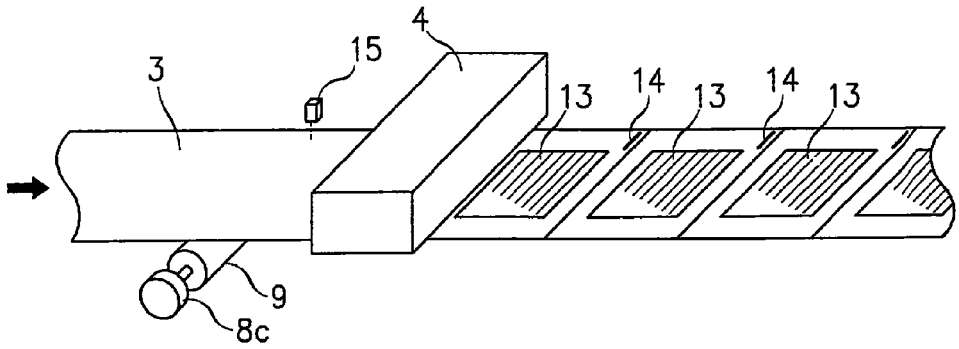
FIG. 2 is an explanatory view illustrating a state of the digital printing system that a process of printing on a web of paper for rotary press is continued.

With the ink jet printer 4, as shown in FIG. 2 images 13 each for one page are printed continuously on a web of paper 3 for rotary press while the web of paper 3 is being fed forwards. And, together with each image 13, a timing mark 14 is printed at an appropriate position. To detect the timing mark 14, there is provided a mark sensor 15 so as to be opposite to the timing mark 14 at a position upstream of the ink jet printer 4 in the direction of forward travel of the web of paper 3.

In the makeup mentioned above, images 13 each for one page and timing marks 14 each for each of the images as shown in FIG. 2 are printed by the ink jet printer 4 on each a surface of the web of paper 3 for rotary press while the web of paper 3 is being fed to travel forwards at a fixed speed.

Figure 3:
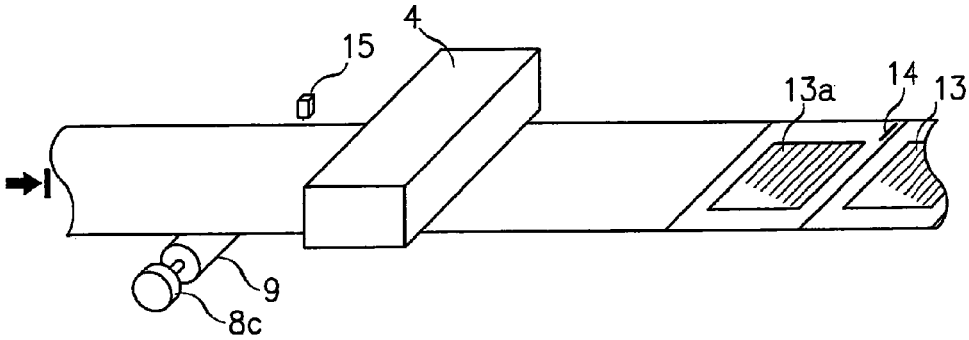
FIG. 3 is an explanatory view illustrating a state of the system when printing on the web of paper has been suspended.

If printing is temporarily halted in course of a continuous printing operation, at a point of time of the halt of printing the printing by the ink jet printer 4 is suspended but the web of paper 3 for rotary press is decelerated and thereafter comes to a stop. This state is shown in FIG. 3. An image 13*a* then last printed on paper at the point of time of the halt of printing is found at a position too far downstream of the ink jet printer 4, and the interval on paper between the last printed image 13*a* and the ink jet printer 4 is left blank over a length corresponding to a time period in which the web of paper 3 is decelerated.

In the conventional printing system of this sort, printing is reinitiated at this state, with the ink jet printer 4, thus from the state shown in FIG. 3, i. e., from the upstream of the portion left blank, with the result of a broke in or waste of paper for rotary press.

Figure 4:
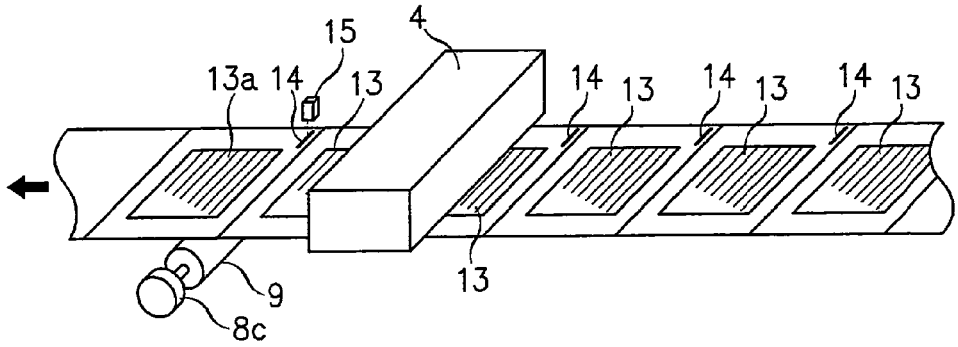
FIG. 4 is an explanatory view illustrating a state of the system that after printing is suspended, the web of paper with printed portions is fed to travel backwards.

According to the digital printing system of the present invention, input of a printing reinitiation signal into the control unit 7 actuates the control unit 7 to furnish a series of control signals to control the motors M1, M2, M3 and M4 for reversely operating the paper feeder unit 2, the paper takeup unit 5 and the feed roll units 6*a* and 6*b* to feed the web of paper 3 backwards, i.e., so that the last printed image 13*a* shifts upstream of the ink jet printer 4. This state of feeding the web of paper 3 backwards is shown in FIG. 4. The length of backward feed as will be described later should be a length corresponding to a run-up length upon reinitiating forward feed thereafter, such that when the last printed image 13*a* passes by the ink jet printer 4, it has a normal forward speed restored. In the backward feed of the web of paper 3, while the image 13*a* printed last at the halt and its downstream images 13 pass by, and travel towards upstream of, the ink jet printer 4, the number of these printed images 13*a*, 13, 13, . . . that have passed by the ink jet printer 4 in the reverse direction is counted by detecting the timing marks 14 provided accompanying them, respectively, by the mark sensor 15.

Figure 5:
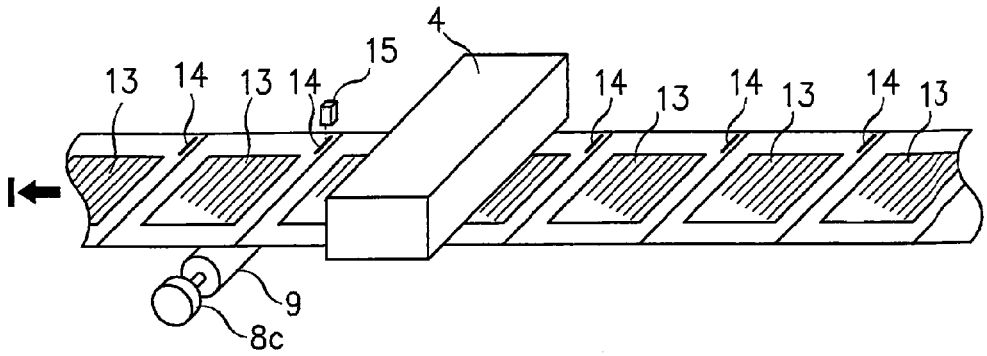
FIG. 5 is an explanatory view illustrating a state of the system that feeding the web of paper to travel backwards is halted.

FIG. 5 shows the state that the backward feed of the web of paper 3 for rotary press is halted. The counted number of the timing marks 14 detected by the mark sensor 15 during the backward feed is input into the control unit 7. Also, the distance of backward travel then of the web of paper 3 for rotary press is detected by the free roll 9 and the encoder 8*c* detecting the number of rotation of the free roll 9 and is input into the control unit 7.

Figure 6:
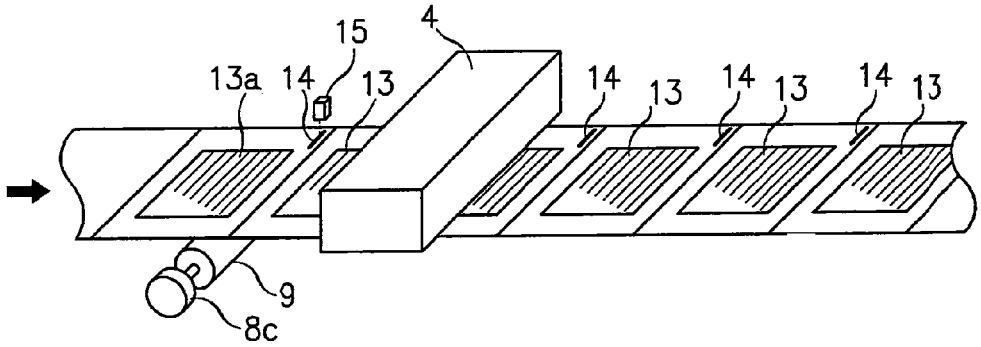
FIG. 6 is an explanatory view illustrating a state of the system that in reinitiating printing, the web of paper is fed to travel forwards.
Figure 7:
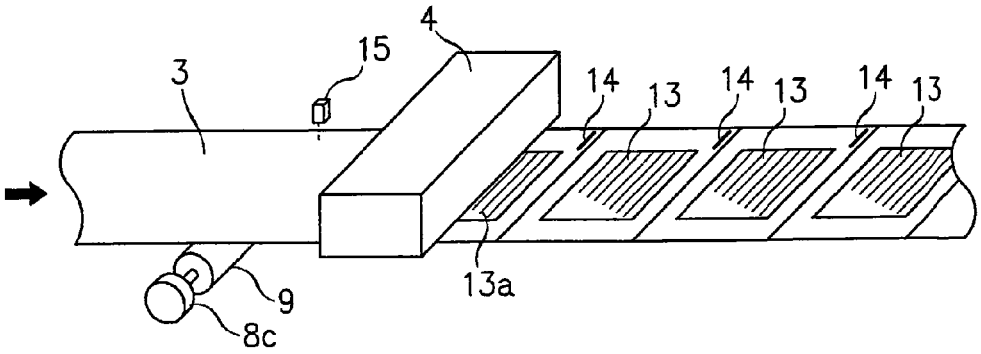
FIG. 7 is an explanatory view illustrating a state the system that with the web of paper continuing to be fed to travel forwards, printing is reinitiated.

From the state that the web of paper 3 for rotary press has been fed to travel backwards over a selected length, the motor M1-M4 are normally actuated to initiate forward feed of the web of paper 3, accelerating its speed of travel. This state is shown in FIG. 6. Then, the number of the images 13 fed to travel forwards is counted by detecting and counting the number of the timing marks 14 with the mark sensor 15, the timing marks 14 accompanying the images 13. Coincidence of this number of counts with the number of counts in the backward feed represents that the last printed image 13*a* has passed over the ink jet printer 4, at which time printing of consecutive images starting from an image which immediately follows the last printed image 13*a* is initiated. This state is shown in FIG. 7.

Since to initiate printing again the web of paper 3 for rotary press has a length reserved, i. e., a distance enough for a necessary time period of acceleration, its traveling speed reaches the predetermined printing speed at the time printing is reinitiated.

Also, at the time, the distance of travel of the web of paper is detected by the encoder 8*c* provided for the free roll 9, and detection signals from the encoder 8*c* determines a position and timing to initiate printing at which the number of counts of timing marks 14 during the forward travel of paper coincides with the number of counts of timing marks 14 during the backward travel of paper to reinitiate printing. This allows re-printing to be initiated precisely from the position immediately following the image 13*a* last printed before printing suspension.

In the form of implementation illustrated, timing marks 14 which each is printed as accompanying each of the images 13 need not necessarily be printed separately from the images 13 in case that there is a portion of a common image portion in each image 13 which can be detected as a timing mark by the mark sensor 15.

Note also that the mark sensor 15 which is arranged to lie upstream of the ink jet printer 4 may be positioned upstream of the feed roll unit 6*a* upstream of the ink jet printer 4 or alternatively between the feed roll unit 6*a* and the ink jet printer 4.

It should also be noted that while the feed roll units 6*a* and 6*b* in the form of implementation illustrated are shown to use pairs of rolls which are driven by the motors M1 and M2, respectively, and in an embodiment in which the web of paper 3 is wound thereon in the form of S, they may each be of a single roll type having a single roll driven in rotational contact with a pinch roll.

Further, while each of the motors M3 and M4 used to drive the web of paper at the paper feeder unit 2 and the paper takeup unit 5, respectively, can be a servo motor, stepping motor or the like, it may be selected from a variety of ones whose rotation can be controlled to be switched between normal and reverse.

Also, the digital printing part may be constructed to allow printing not only with an ink jet printer but also be with such as an electrophotographic printer capable of instantaneously initiating printing on a face immediately following a predetermined printed face.

What is claimed is:

1. A digital printing method in which images for a page are each consecutively printed by a digital printer on a web of paper for a rotary press fed in a forward feed direction of travel and in which after printing is temporarily halted while the web of paper is en route, printing is reinitiated on the web of paper and fed again in the forward feed direction of travel, the method comprising:

printing a timing mark for each of said images;

in re-printing after printing is temporarily halted while the web of paper is en route, feeding the web of paper backwards such that a plurality of images printed thereon before printing is temporarily halted is moved in an upstream direction of the digital printer and thereafter re-feeding the web of paper in the forward feed direction, and counting, upstream of the digital printer, a number of timing marks for each image in each of the forward feed and backward feed directions of the web of paper; and when the number of the timing marks counted in the forward feed direction coincides with the number of the timing marks counted in the backward feed direction, reinitiating consecutive printing of the images from a position immediately following an image last printed before the printing is temporarily halted.

2. The digital printing method as set forth in claim 1, wherein a distance of travel of the web of paper upstream of the digital printer is detected by a travel distance detector, and when the number of the timing marks counted in the forward feed direction coincides with the number of the timing marks counted in the backward feed direction to reinitiate the printing, a position in timing is determined from detected values by said travel distance detector to reinitiate the printing.

3. A digital printing system, comprising:

a digital printer for printing images for each page and timing marks for each of the images on a web of paper fed in a forward direction of travel;

an upstream and a downstream roll unit positioned upstream and downstream, respectively, of the digital printer in a forward feed direction, the roller units being operable synchronously to feed the web of paper to travel in the forward feed direction during printing thereon and to feed the web of paper in a backward direction of travel after printing is temporarily halted while the web of paper is en route;

a paper feeder and a paper takeup unit provided upstream of the upstream feed roll unit and downstream of the downstream feed roll unit, respectively, and rotatable normally and reversely in conjunction with operations of the upstream and downstream roll units;

a mark sensor positioned upstream of the digital printer in the forward feed direction for counting timing marks in a backward feed direction after the printing is temporarily halted while the web of paper is en route and for counting timing marks in a subsequent forward feed direction; and a control unit provided with a number of counts from the mark sensor in the backward feed direction after the printing is temporarily halted while the web paper is en route and a number of counts from the mark sensor in the subsequent forward feed direction and operable, when the number of the timing marks counted in the subsequent forward feed direction coincides with the number of the timing marks counted in the backward feed direction, for providing the digital printer with a signal which commands re-initiation of printing consecutive images from a position immediately following an image last printed before the printing is halted.

4. The digital printing system as set forth in claim 3, further comprising:

a travel distance detector arranged upstream of the digital printer for detecting a distance of travel of the web of paper;

wherein the control unit receives detected values by the travel distance detector and signals from the mark sensor, and a detection signal from the travel distance detector determines a timing position at which to reinitiate the printing.

* * * * *